US006178705B1

(12) United States Patent
Lefebvre

(10) Patent No.: US 6,178,705 B1
(45) Date of Patent: Jan. 30, 2001

(54) SUSPENSION AND SOUND-INSULATION SYSTEM

(76) Inventor: Yvon Lefebvre, 3045 Edouard VII, St. Philippe de Laprairie (CA), J0L 2K0

( * ) Notice: Under 35 U.S.C. 154(b), the term of this patent shall be extended for 0 days.

(21) Appl. No.: 09/329,757

(22) Filed: Jun. 10, 1999

(30) Foreign Application Priority Data

Jun. 15, 1998 (CA) ..... 2239257

(51) Int. Cl.[7] ..... E04B 1/82

(52) U.S. Cl. ..... 52/144; 52/167.7; 52/403.1; 52/480; 52/773

(58) Field of Search ..... 52/144, 167.7, 52/167.8, 396.04, 403.1, 480, 773, 781.3; 248/603, 615, 634

(56) References Cited

U.S. PATENT DOCUMENTS

| | | | | |
|---|---|---|---|---|
| 1,572,574 | * | 2/1926 | Stromborg | 52/167.7 X |
| 4,869,479 | * | 9/1989 | Colonel et al. | 52/480 X |
| 4,942,075 | * | 7/1990 | Hartel et al. | 248/634 X |
| 5,102,107 | * | 4/1992 | Simon et al. | 248/634 X |

* cited by examiner

*Primary Examiner*—Christopher T. Kent
(74) *Attorney, Agent, or Firm*—Darby & Darby

(57) ABSTRACT

The suspension and sound-insulation system is intended to be used in houses or buildings. In this system, a finishing panel is attached to a rigid structure surface by a plurality of rubber cylinders each provided with an open cavity extending axially. Each cylinder is attached to the structure surface by a suspension rod provided with opposite ends, which is inserted into the cavity of the cylinder and whose opposite ends are folded so as to extend the structure surface and be fixed thereto. The finishing panel is attached to suspension bars that are attached to the cylinders by other suspension rods passing through the cavities of the cylinders. The cavities of the rubber cylinders are axially offset and the cylinders are oriented during their installation in such a manner that their cavities are closer to the structure surface and to the suspension bars. The other suspension rods are also shaped and sized to receive and support one of the suspension bars. Each of these other suspension rods is U-shaped and comprises a central portion and two opposite side portions that are perpendicular to the central portion and each provided with a hole. A pin is shaped and sized to be inserted into the holes made in the side portions of each other suspension rod while passing through the cavity of one of the cylinders. This system has the advantage of reducing the risk of contact between, on the one hand, the suspension rods used to attach the cylinders to the structure surface and, on the other hand, the other suspension rods used to attach the suspension bars to the cylinders. This system has also the advantage of giving a better sound-insulation by providing a larger thickness of rubber between the suspension bars and their suspension rods.

8 Claims, 2 Drawing Sheets

SUSPENSION AND SOUND-INSULATION SYSTEM

BACKGROUND OF THE INVENTION a) Field of the Invention

The present invention relates to the sound-insulation of structural components of a house or building, such as ceilings, walls or floors.

b) Brief Description of the Prior Art

A major consideration in the contraction of a house or building is to provide a suitable sound-insulation. The construction standards establish that the level of aerial noises expressed in frequencies should range between 125 to 4000 Hz. However, impact noises ranging between 100 and 3150 Hz and all the low frequency noises are not subjected to reglementations and can be particularly painful for residents of a house or building. For example, the sound of heels on a floor, the cracking of floors or the noise of different apparatuses for industrial or home use, may be painful and cumbersome.

The prior art in this field includes a suspension and sound-insulation system that was made by the present inventor and is presently offered for sale under the tradename CALI. This system is designed to reduce low frequency noises and impact noises in addition to offering an insulation level much higher than the conventional one. In this system, a plurality of rubber cylinders are used to support the finishing panels of a house or building, in order to reduce the transmission of the noises between the structure and these panels. This system may also be used in installing motors, garage doors or any other apparatus which could induce undesirable vibrations. Each rubber cylinder has a cavity extending axially and centrally, and an inner cylindrical layer made of a rigidifying material that preferably consists of a twisted rope. All the cylinders are attached to a rigid structural surface of the infra-structure, such as wood beams, and they support suspension bars to which are attached the finishing panels, which can be parts of a ceiling or wall. A suspension rod preferably made of metal and provided with two opposite ends, is used to attach each cylinder to the structure surface. The suspension rod is inserted into the cavity of the corresponding cylinder and its opposite ends are folded so as to extend up to the structure surface and be fixed thereto. The suspension bars are attached to the cylinders opposite to the structural surface with fixation means consisting of a set of metal wires. The wires are wrapped around the suspension bars, inserted into the cavities of the cylinders and twisted together in order to connect them. In this manner, each suspension bar is attached to each cylinder without being in contact with the structure of the house or building. The sound transmitted by the structure to the suspension bar is therefore damped by the cylindrical cylinders.

This known system is efficient but must be installed with care, since any contact between the suspension rods used to attach the cylinders to the structure surface and one or more metal wires used to attach the suspension bars may substantially reduce the insulating efficiency.

SUMMARY OF THE INVENTION

The present invention is concerned with an improvement to the suspension and sound-insulation system CALI disclosed hereinabove. The improved lies in that:

a) the rubber cylinders have cavities that are axially offset and they are oriented during their installation in such a manner that their cavities are closer to the structure surface than to the suspension bars; and b) the metal wires used as fixation means are replaced by other fixation means which each comprises:

another suspension rod shaped and sized to receive and support of the suspension bars, said other suspension rod being U-shaped and comprising a central portion and two opposite side portions that are perpendicular to the central portion, each side portion having at least one hole; and a pin shaped and sized to be inserted into the holes may be the side portion of the other suspension rods suspension worldwide passing through the cavity of one of the cylinders.

With this improvement, fixation of the suspension bars to the rubber cylinders is carried out by positioning the suspension bars and the rubber cylinders between the side portion of the other suspension rods and then by inserting the pins respectively in the holes of the first side portions of the other suspension rods, in the cavities of the cylinders and in the holes of the second side portions of the other suspension rods, in this order.

Preferably, each pin has a head and two foldable legs opposite to the heads, and it is fixed and held in place by folding its legs at angle after insertion and installation.

This improvement to the CALI system has the advantage of reducing the risk of contact between, on the one hand, the suspension rods used to attach the rubber cylinders to the structure surface and, on the other hand, the other suspension rods used to attach the suspension bars to the rubber cylinders.

This improvement also has the advantage of providing a better sound-insulation, since there is a larger thickness of rubber between the suspension bars and their suspension rods.

The invention and its advantages will be better understood upon reading the following non-restrictive description of a preferred embodiment thereof, made with reference to the accompanying drawings.

DESCRIPTION OF A PREFERRED EMBODIMENT OF THE INVENTION

Figure 1:
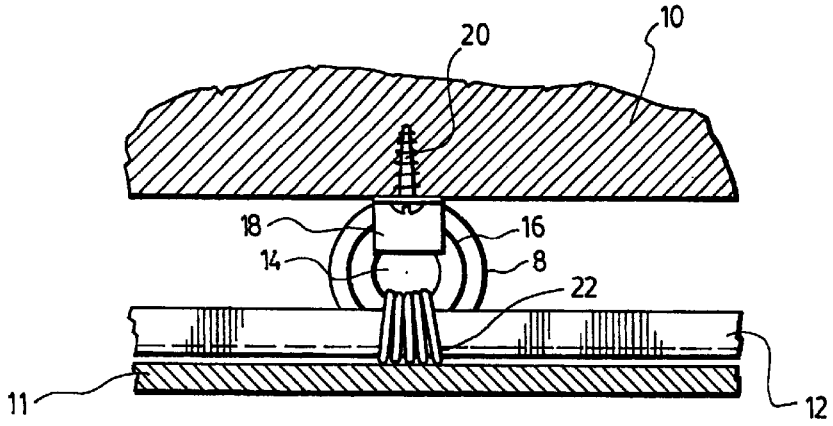
FIG. 1 (PRIOR ART)
FIG. 1 is a side elevational view of a suspension and sound-insulation system according to the prior art.
Figure 2:
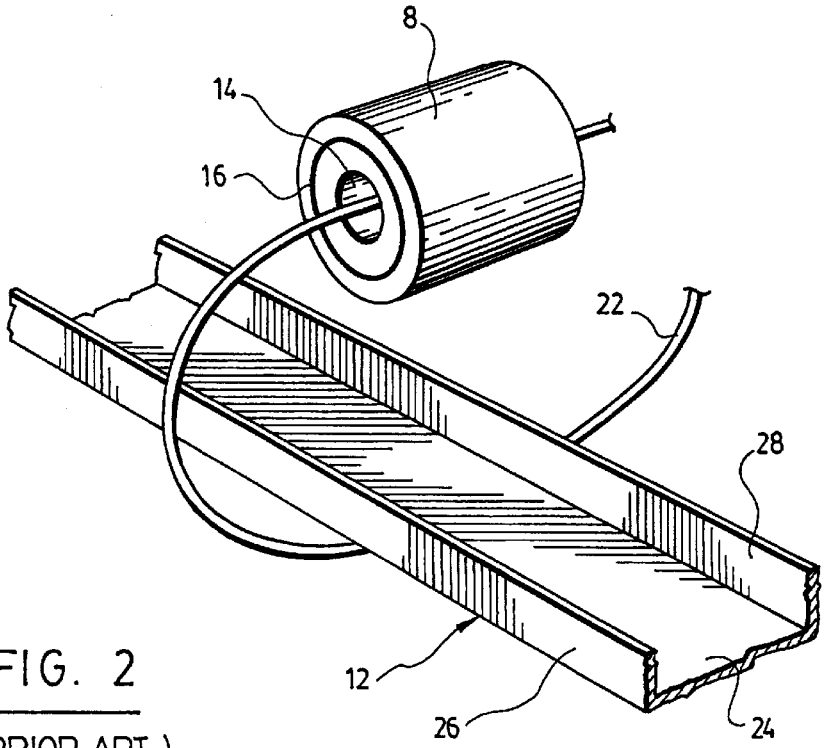
FIG. 2 ( PRIOR ART )
FIG. 2 is an exploded perspective view of part of the system as shown in FIG. 1.

As already explained hereinabove, the present invention is an improvement to the suspension and sound-insulation system known under the tradename CALI. FIGS. 1 and 2, identified as "prior art" illustrate this known system and show the way a rubber cylinder 8 can be fixed to the rigid surface of the building structure, such as a wooden beam 10, in order to support a finishing panel 11 which is itself attached to a suspension bar 12. As shown, the rubber cylinder 8 has a cavity extending axially and centrally, and an inert cylindrical layer 16 made of a rigidifying material, such as a twisted rope.

Figure 3:
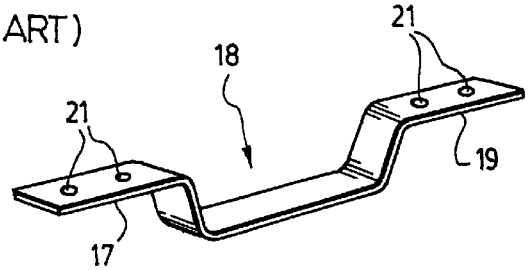
FIG. 3 is a perspective view of a suspension rod for use to fix a rubber cylinder to the structure surface in the suspension and insulation system according to both the prior art and to the invention.

FIG. 1 shows that the rubber cylinder 8 is attached to the wooden beam 10 by means of the suspension rod 18 made of metal, which is inserted into the central cavity 14. This rod 18 has two opposite ends 17 and 19 which are folded so as to extend flat onto the structure surface 10 and be attached to it. The rod 18 is shown in greater detail in FIG. 3. Each of its ends 17 and 18 has at least one hole 21, through which a screw 20 or any other attaching means such as a nail can be inserted to attach the rod 18 to the beam 10. Two or more holes 21 for use with a corresponding set of screws or nails, can of course be provided on each end of the rod 18 to make its attachment stronger.

The suspension bars 12 are attached by means of metal wires 22 directly to the rubber cylinder 8 on their sides which are opposite to the wooden beam 10. This suspension bar 12 is preferably linear and has a U-shaped cross-section defining a bottom wall 24 and two sidewalls 26 and 28 perpendicular to the bottom wall. This suspension bar is preferably made of metal. The width of the suspension bar 12 is substantially identical to the length of the cylinders 8, so that the cylinders 8 may fit within the bar between the sidewalls 26 and 28 thereof. As shown in FIG. 2 with only one wire for the purpose of simplicity, the wires 22 are wrapped around the suspension bar 12 and slid into the central cavity 14 of each cylinder. Their ends are thereafter twisted together in order to connect the structural components together. Several wires can be used for a better rigidity. Alternatively, a single wire may be folded several times to achieve the same result.

The improvement made in accordance with the invention to the system disclosed hereinabove is two-fold.

Figure 4:
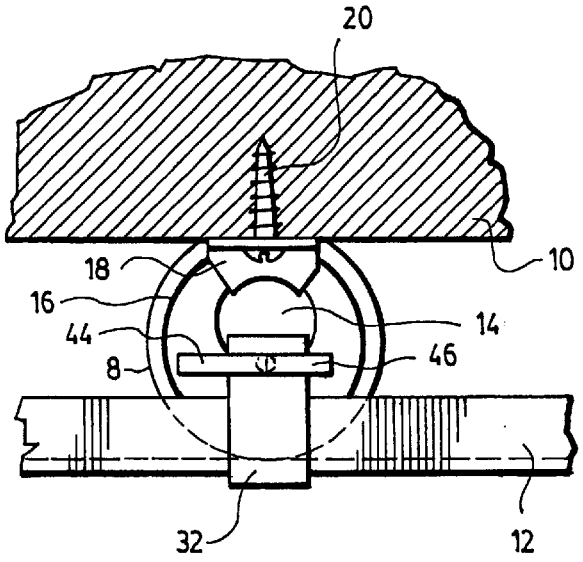
FIG. 4 is a side elevational view of a suspension and insulation system according to a preferred embodiment of the invention.

First of all, the cavity 14 of each rubber cylinder is axially offset, as shown in FIG. 4. During installation, the side of the cylinder that is the thinnest, is attached to the wooden beam 12. The other side which is the thickest, supports the suspension bar 12. This is particularly advantageous since the sound-insulation property of the suspension system is mainly dependent upon the absorption of the vibrations generated in the suspension bars. Preferably, the inner cylindrical layers made of reinforcing materials 16 are located so as to extend close to the external surface of the cylinders so as not to interfere with the cavity 14 on the thinner side of the cylinder 8. Preferably also, the central part of the suspension rod 18 is transversally curved to follow the shape of the cavity of the corresponding cylinder, as is shown in FIG. 4. This has the advantage of reducing the damage that can be done to the rubber cylinder 8 by the side edges of the suspension rod 18.

Figure 6:
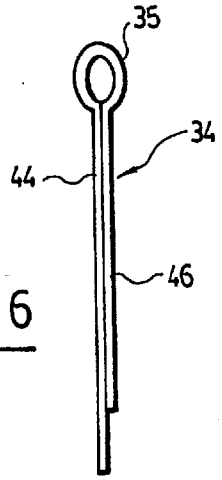
FIG. 6 is a side elevational view of the pin used in the system shown in FIGS. 4 and 5.
Figure 5:
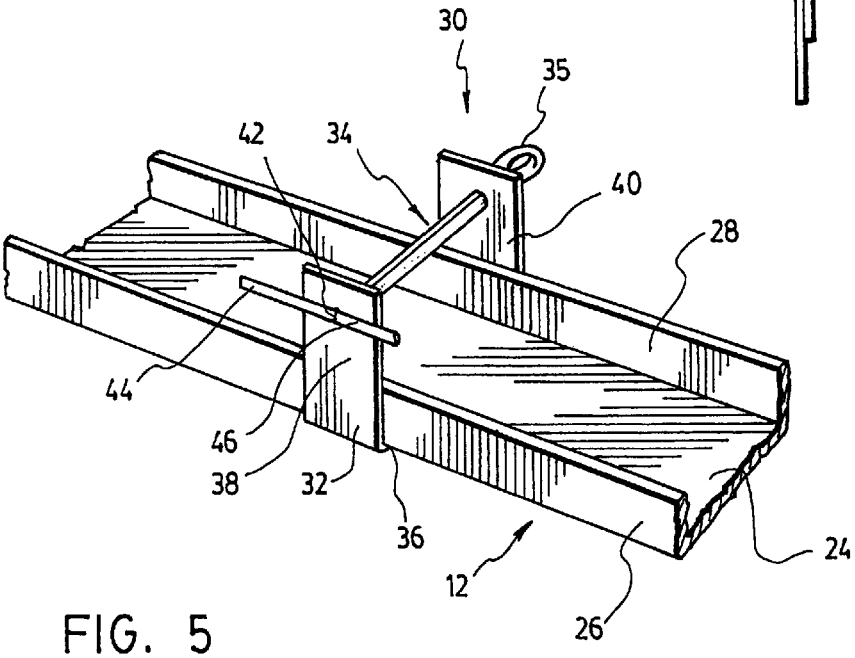
FIG. 5 is a perspective view of the suspension rod and suspension bar of the suspension and insulation system shown in FIG. 4.

The second improvement of the present invention over the prior art system, is better shown in FIGS. 4, 5 and 6. In accordance with the invention, the metal wires 22 are actually replaced by other fixation means 30, each comprising another suspension rod 32 preferably made of metal, and a pin 34. The second suspension rod 32 is U-shaped and comprises a central portion 36 and two onto side portions 38 and 40 that are perpendicular to the central portion. Each side portion has at least one hole 42. In a particularly preferred embodiment of the invention, the first and second suspension bands 18 and 32 can be made as similar pieces of metal and be subsequently given a suitable shape to perform each of their functions. The width of the central portion 36 of the second suspension rod 32 is preferably selected so that the suspension bar 12 may fit exactly between the two perpendicular side portions 38 and 40. Preferably, the pin 34 is provided with a head 35 and two foldable legs 44 and 46 opposite to the head 35, as shown in FIG. 6. To attach the suspension rod 12 to the rubber cylinder 8, the suspension bar 12 is positioned so that the cylinder 8 be fit between the two side portions 17 and 19 of the bar 12. Then, the second metal rod 32 is fit over the suspension bar 12 as shown in FIG. 5. The holes 42 in both side portions 38 and 40 of the second suspension rod 32 are aligned with the cavity 14 of the rubber cylinder 8, and the pin is inserted through these holes and the cavity 14. The two foldable legs 44 and 46 are thereafter folded perpendicularly to the axis of the pin 34, as shown in FIGS. 4 and 5, to rigidly hold the rubber cylinder 8 and the suspension bar 12.

The combination of a thicker layer of rubber adjacent to the suspension bars 12 with the use of fixation means 30 with less metal into the cavities 14 of the rubber cylinders substantially reduces the risk of accidental contact between the metallic elements used to attach the cylinders to the beams 10 and suspension bars 12 respectively. This in turn improves the sound-insulation property of the suspension system. Moreover, the fixation means of the present invention take much less space and are easier to install than a bunch of metallic wires 22.

In use, a plurality of rubber cylinders 8 are attached at regular intervals to the structure of a ceiling or wall. Then, finishing panels are attached to the rubber cylinders through the suspension bars.

The resulting system permits to reduce transmission noise to about 70 FSTC (field sound transmission class). It is particularly efficient to absorb low frequency sounds which are not subject to reglementations, especially those ranging from 40 to 45 dB.

Of course, numerous modifications could be made to the preferred embodiment disclosed hereinabove without departing from the scope of the present invention. By way of non-restrictive examples, other kinds of pins could be used, such as nails the tips of which could be folded after installation. The shape of the pieces, such as, for example, the shape of the suspension bars, could also be easily modified.

What is claimed is:

1. In a suspension and sound-insulation system for a house or a building, wherein a finishing panel is attached to a rigid structure surface by a plurality of rubber cylinders each provided with an open cavity extending axially, each cylinder being attached to the structure surface by means of a suspension rod provided with opposite ends, said rod being inserted into the cavity of the cylinder and its opposite ends being folded so as to extend up to the structure surface and be fixed thereto, the finishing panel being attached to suspension bars that are attached to the cylinders by fixation means passing through the cavities of the cylinders, the improvement wherein:

the cavities of the rubber cylinders are axially offset and the cylinders are oriented during their installation in such a manner that their cavities are closer to the structural surface than to the suspension bars; and each of the fixation means comprises:

another suspension rod shaped and sized to receive and support one of the suspension bars, said other suspension rods being U-shaped and comprising a central portion and two opposite side portions that are perpendicular to the central portion, each side portion having at least one hole; and a pin shaped and sized to be inserted into the holes made in the side portions of the other suspension rod while passing through the cavity of the one of the cylinders.

2. The improved system of claim 1, wherein each pin has a head and two foldable legs opposite to said head, said pin being fixed and held in place by folding its legs at an angle after insertion of the pin into the cavity of the cylinder and into the holes on the side portions of the other suspension rod.

3. The system of claim 1, wherein the suspension rods used to attach the cylinders to the structure surface are transversally curved to follow the shape of the cavity of the corresponding cylinders and reduce the risk of damages made to said cylinders.

4. The improved system of claim 1, wherein each cylinder is provided with an internal cylindrical layer made of a rigidifying material.

5. The improved system of claim 1, wherein the cylinders are of the same length and the suspension bars are linear and have a U-shaped cross-section with a width corresponding to the length of each cylinder in order to fit onto said cylinders.

6. The improved system of claim 1, wherein the suspension rods and the other suspension rods are made of metal and the opposite ends of the suspension rods used to attach the cylinders to the structure surface have transverse holes and are fixed to said structure surfaces by means of screws inserted into said holes.

7. The improved system of claim 6, wherein:

the cylinders are of the same length and the suspension bars are linear and have a U-shaped cross-section with a width corresponding to the length of each cylinder in order to fit onto said cylinders;

the suspension rods used to attach the cylinders to the structure surface are transversally curved to follow the shape of the cavity of the corresponding cylinders and reduce the risk of damages made to said cylinders.

8. The improved system of claim 7, wherein each pin has a head and two foldable legs opposite to said head, said pin being fixed and held in place by folding its legs at an angle after insertion of the pin into the cavity of the cylinder and into the holes on the side portions of the other suspension rod.

* * * * *